US005711539A

United States Patent [19]

Tang

[11] Patent Number: 5,711,539

[45] Date of Patent: Jan. 27, 1998

[54] MAGNETICALLY-RESTORED STEERABLE ROLLER SKATE

[76] Inventor: Kuo-Tai Tang, c/o Hung Hsing Patent Service Center, P.O. Box 55-1670, Taipei, Taiwan

[21] Appl. No.: 639,761

[22] Filed: Apr. 29, 1996

[51] Int. Cl.[6] ..... A63C 1/00

[52] U.S. Cl. ..... 280/11.27; 280/11.28; 280/87.042; 280/809

[58] Field of Search ..... 280/11.27, 11.28, 280/81.6, 11.19, 776, 268, 271, 809, 816, 87.042; 16/320

[56] References Cited

U.S. PATENT DOCUMENTS

| | | | |
|---|---|---|---|
| 4,838,564 | 6/1989 | Jarvis | 280/11.28 |
| 5,183,277 | 2/1993 | Tang | 280/11.28 |
| 5,441,287 | 8/1995 | Tang | 280/11.28 |

*Primary Examiner*—Brian L. Johnson
*Assistant Examiner*—Jonathan E. Butts

[57] ABSTRACT

A steerable roller skate includes: a sole member of a skate boot or strap of roller skate having a pair of rear wheels transversely rotatably secured to a rear bottom portion of the sole member, a steering base steerably secured on a front bottom portion of the sole member, a pair of front wheels transversely rotatably secured on the steering base, a first magnet secured on a central bottom portion of the sole member, and a second magnet secured on the steering base adjacent to the first magnet having opposite magnetic polarities of the first and second magnets for normally attracting the second magnet to the first magnet for magnetically restoring the steering base and the front wheels for automatically resetting a straightforward orientation of the roller skate.

4 Claims, 3 Drawing Sheets

MAGNETICALLY-RESTORED STEERABLE ROLLER SKATE

BACKGROUND OF THE INVENTION

U.S. Pat. No. 5,441,287 issued to the same inventor of this application disclosed a stabilizing disk mounted on an intermediate bottom portion of the sole member for frictionally contacting a rear base portion of the steering base steerably secured on a front bottom portion of the sole member for stabilizing the steering base when biasing the steering base in different directions for enhancing skate safety.

Due to the frictional contacting between the stabilizing disk and the steering base, the front wheels (3) and the steeering base (25), once being biased rightwardly or leftwardly, will not be automatically restored to allow the front axle (31) to be projectively perpendicular to the longitudinal axis (10) longitudinally defined at a central portion of the sole member (1) when the skater lifts his or her foot during the skating, possibly confusing the skating orientations and influencing the maneuverability of the skater.

The present inventor has found the drawbacks of the U.S. Pat. No. 5,441,287 and invented the steerable roller skate which is magnetically restorable.

SUMMARY OF THE INVENTION

The object of the present invention is to provide a steerable roller skate including: a sole member of a skate boot or strap of roller skate having a pair of rear wheels transversely rotatably secured to a rear bottom portion of the sole member, a steering base steerably secured on a front bottom portion of the sole member, a pair of front wheels transversely rotatably secured on the steering base, a first magnet secured on a central bottom portion of the sole member, and a second magnet secured on the steering base adjacent to the first magnet having opposite magnetic polarities of the first and second magnets for normally attracting the second magnet to the first magnet for magnetically restoring the steering base and the front wheels for automatically resetting a straightforward orientation of the roller skate.

DETAILED DESCRIPTION

Figure 1:
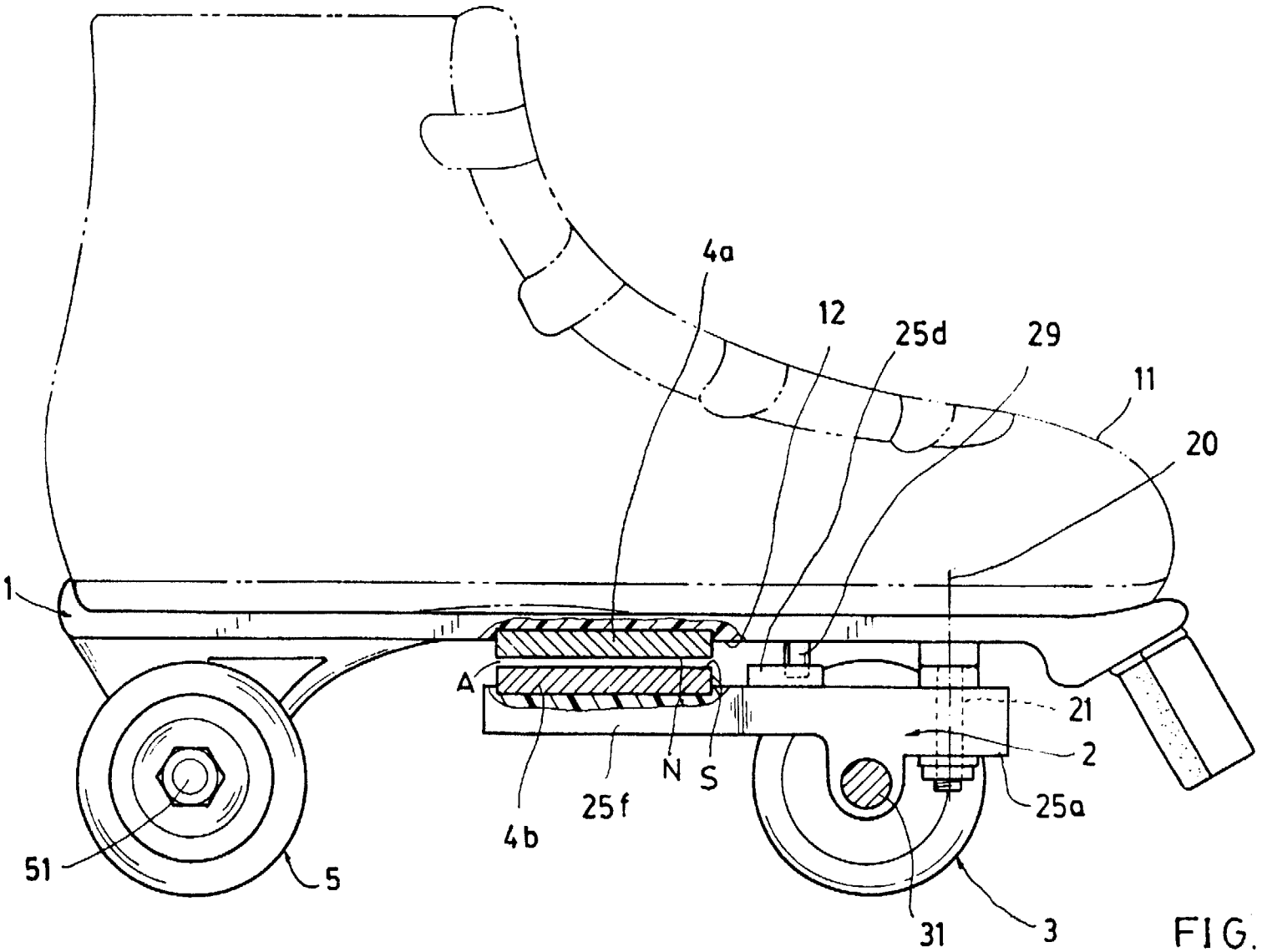
FIG. 1 is an illustration showing a roller skate of the present invention.
Figure 2:
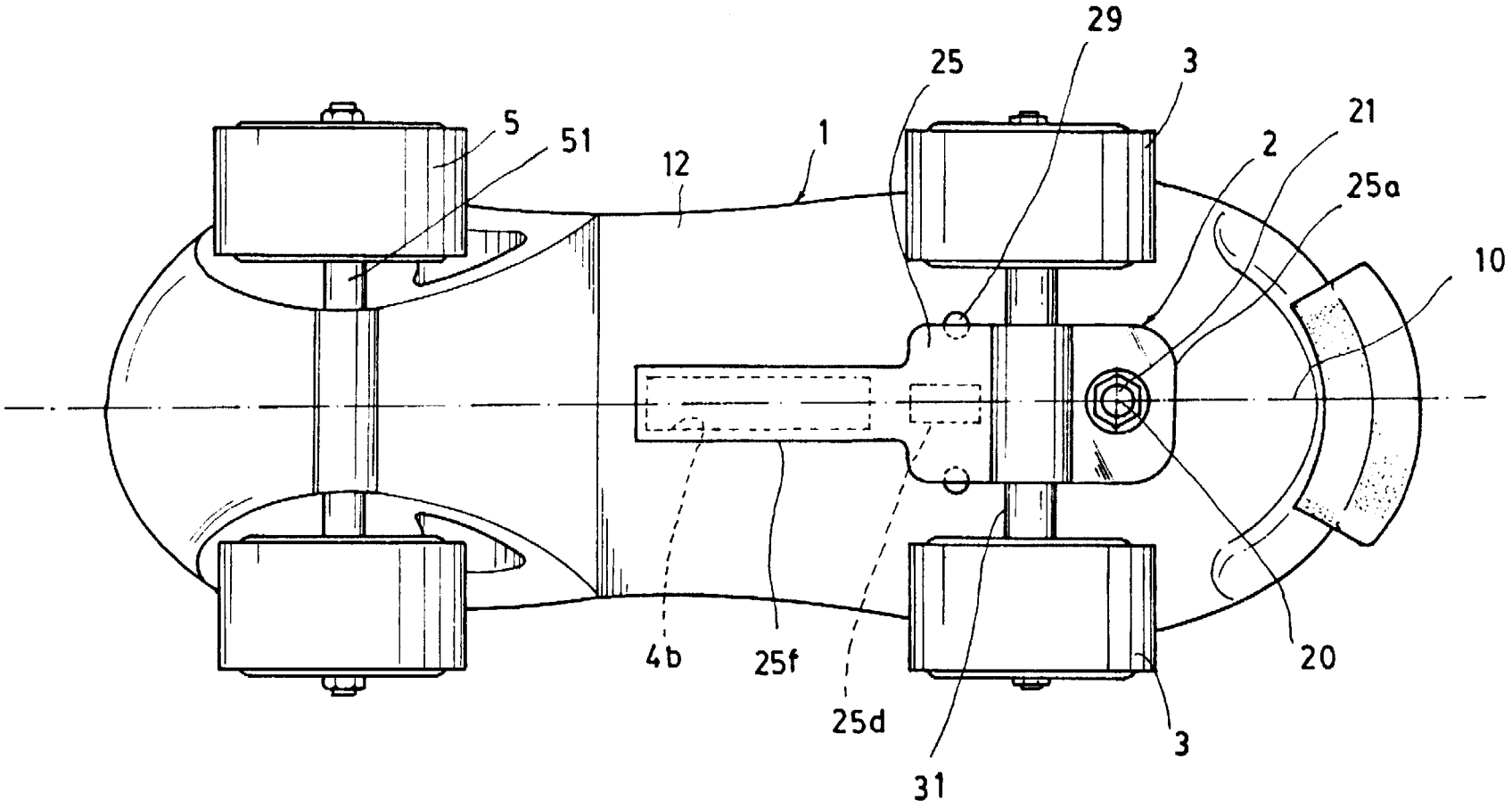
FIG. 2 is a bottom view of the present invention.

As shown in the drawing figures, a preferred embodiment of the roller skate of the present invention comprises: a sole member 1 of a skate boot or fastening strap 11 of a roller skate defining a longitudinal axis 10 at a longitudinal center of the sole member 1, a steering means 2 steerably secured to a front bottom portion of the sole member 1, a pair of front wheels 3 rotatably transversely secured on the steering means 2 by a front axle 31, a pair of rear wheels 5 rotatably transversely secured to a rear bottom portion of the sole member 1, a first magnet 4*a* secured on a central bottom portion 12 of the sole member 1, and a second magnet 4*b* secured on the steering means 2. The pair of rear wheels 5 are rotatably secured on a rear axle 51, generally perpendicular to the longitudinal axis 10 of the sole member 1.

The steering means 2 includes: a steering base 25 having a front base portion 25*a* drilled with a vertical bolt hole for rotatably engaging a front bolt 21 vertically secured in a front bottom portion of the sole member 1 about a front vertical axis 20, an axle hole horizontally transversely formed through a middle portion of the steering base 25 for rotatably engaging a front axle 31 for rotatably securing the pair of front wheels 3 on the steering base 25, and a rear extension portion 25*f* formed on a rear portion of the steering base 25. The vertical axis 20 of the bolt 21 is projectively perpendicular to the longitudinal axis 10 of the sole member 1.

The first magnet 4*a* secured on the central bottom portion 12 of the sole member 1 has a magnetic polarity opposite to a magnetic polarity of the second magnet 4*b* secured on the rear extension portion 25*f* of the steering base 25 for a mutual magnetic attraction between the first and second magnets 4*a*, 4*b*.

Naturally, the first magnet 4*a* may be attracted to a ferrous plate (not numbered) secured to the bottom 12 of the sole member 1 to substitute the second magnet 4*b* for a mutual magnetic attraction between the first magnet 4*a* and the ferrous plate.

The bottom portion 12 of the sole member 1 and the steering base 25 may be made of non-ferrous materials for preventing loss of magnetic property of the magnets 4*a*, 4*b*.

The steering base 25 further includes a limiting projection 25*d* protruding upwardly from a central portion of the steering base 25 to be retarded by a pair of stoppers 29 respectively disposed on two opposite side portions on a front bottom portion of the sole member 1 to prevent falling off of a skate player when rightwardly or leftwardly steering a roller skate of the present invention.

The first magnet 4*a* has a center aligned with the longitudinal axis 10 of the sole member 1. The second magnet 4*b* secured on the steering base 25 is positioned corresponding to and adjacent to the first magnet 4*a* to define an aperture A between the first and second magnets 4*a*, 4*b*.

The shapes of the two magnets 4*a*, 4*b* are not limited in the present invention and are preferably rectangular shaped.

The fixing or joining methods for securing the two magnets on the skate are not limited in this invention.

Figure 3:
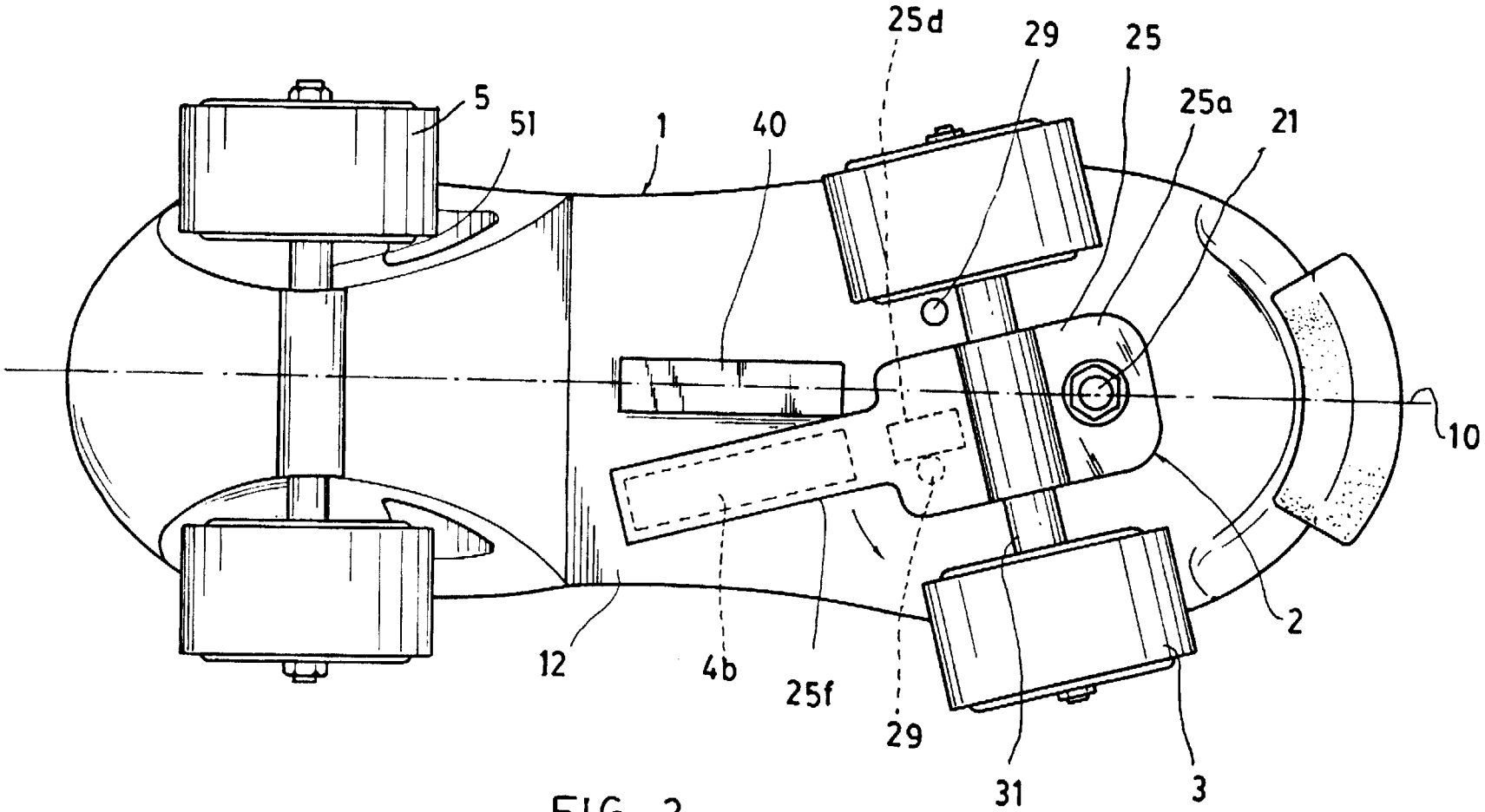
FIG. 3 is a bottom view illustration showing a roller skate as sidewardly biased.

Upon a skating by a player, the front wheels 3 may be biased sidewardly as shown in FIG. 3 to forcibly move the second magnet 4*b* from the first magnet 4*a* for diviating the skating direction from a straightforward direction aligned with the longitudinal axis 10 to a sideward orientation as shown in the arrow direction in FIG. 3.

Then, the player lifts his foot for a next skating step, the magnetic attraction between the two magnets 4*a*, 4*b* will automatically restore the steering base 25 to allow the front axis 31 to be perpendicular to the longitudinal axis 10 of the sole member for resetting a straightforward direction, ready for next biasing movement either rightwardly or leftwardly.

Therefore, the present invention is superior to the U.S. Pat. No. 5,441,287 for automatically restoring or resetting the front wheels for an initial straightforward skating orientation for enhancing safety and maneuverability.

The present invention may be modified without departing from the spirit and scope of the invention.

I claim:

1. A steerable roller skate comprising:

a sole member having a longitudinal axis defined at a central portion thereof and having a pair of rear wheels transversely rotatably secured to a rear bottom portion of said sole member, a steering means having a steering base steerably secured to a front bottom portion of said sole member, a pair of front wheels transversely rotatably secured to the steering base of said steering means by a front axle, a first magnet secured to a central bottom portion of said sole member, and a second magnet secured on said steering base normally positioned under said first magnet, said first and second magnets having opposite magnetic polarities thereof for a mutual magnetic attraction between said first and second magnets for normally restoring the steering base and the front wheels to allow said front axle to be projectivety perpendicular to said longitudinal axis of said sole member for a normal straightforward skating of said roller skate.

2. A steerable roller skate according to claim 1, wherein said second magnet is secured in a rear extension portion of said steering base to correspond to said first magnet secured at a central bottom portion of said sole member, said rear extension portion protruding rearwardly from said steering base.

3. A roller skate according to claim 1, wherein said first magnet is secured on said central bottom portion of said sole member, having a center of said first magnet aligned with the longitudinal axis of said sole member.

4. A roller skate according to claim 1, wherein each said magnet is formed as a rectangular shape.

* * * * *